US011802468B2

(12) United States Patent
Publes et al.

(10) Patent No.: US 11,802,468 B2
(45) Date of Patent: Oct. 31, 2023

(54) ASYMMETRIC POWER MANAGEMENT AND LOAD MANAGEMENT

(71) Applicant: Caterpillar Inc., Peoria, IL (US)

(72) Inventors: Andy Publes, Katy, TX (US); Casey A. Otten, Spring, TX (US); Perry D. Converse, Lafayette, IN (US); Yanchai Zhang, Dunlap, IL (US); Zhijun Cai, Dunlap, IL (US); Baoyang Deng, Edwards, IL (US); Christopher G. Y. Haddad, Morris, IL (US); Jason T. Herlehy, The Woodlands, TX (US); Todd R. Kabrich, Tomball, TX (US); Nausheen Ahmad, Dunlap, IL (US); Joseph C. Bufkin, Spring, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/582,542

(22) Filed: Jan. 24, 2022

(65) Prior Publication Data

US 2023/0235653 A1 Jul. 27, 2023

(51) Int. Cl.
*E21B 43/26* (2006.01)
*E21B 44/00* (2006.01)

(52) U.S. Cl.
CPC ..... *E21B 43/2607* (2020.05); *E21B 43/26* (2013.01); *E21B 44/00* (2013.01)

(58) Field of Classification Search
CPC ..... E21B 43/2607; E21B 43/26; E21B 44/00
See application file for complete search history.

(56) References Cited

U.S. PATENT DOCUMENTS

| | | | |
|---|---|---|---|
| 8,205,594 | B2 | 6/2012 | Fore et al. |
| 9,255,531 | B2 | 2/2016 | Zhang et al. |
| 9,683,503 | B2 | 6/2017 | Zhang et al. |
| 9,889,915 | B2 | 2/2018 | Zhang et al. |
| 9,896,982 | B1 | 2/2018 | Zhang et al. |
| 10,131,599 | B2 | 11/2018 | Olah et al. |
| 10,151,192 | B2 | 12/2018 | Burress et al. |
| 10,415,348 | B2 | 9/2019 | Zhang et al. |
| 10,458,352 | B2 | 10/2019 | Zhang et al. |
| 10,563,649 | B2 | 2/2020 | Zhang et al. |
| 10,597,996 | B2 | 3/2020 | Boone |
| 10,734,814 | B2 | 8/2020 | Converse et al. |
| 10,760,996 | B2 | 9/2020 | Converse et al. |
| 10,815,764 | B1 * | 10/2020 | Yeung ..... F04B 51/00 |
| 10,890,061 | B2 | 1/2021 | Cai et al. |
| 10,914,155 | B2 | 2/2021 | Oehring et al. |

(Continued)

FOREIGN PATENT DOCUMENTS

WO 2020219088 A1 10/2020

OTHER PUBLICATIONS

Unpublished U.S. Appl. No. 17/110,415, filed Dec. 3, 2020.

*Primary Examiner* — James G Sayre

(57) ABSTRACT

A method may include receiving information related to operation or a configuration of a hydraulic fracturing system. The hydraulic fracturing system may include a plurality of electric power source outputs and a plurality of hydraulic fracturing rigs. The method may further include performing, based on the information, asymmetric power management of the plurality of electric power source outputs. The method may further include performing, based on the information, asymmetric load management of the plurality of hydraulic fracturing rigs.

20 Claims, 7 Drawing Sheets

(56) References Cited

U.S. PATENT DOCUMENTS

| | | | | |
|---|---|---|---|---|
| 10,927,774 | B2 | 2/2021 | Cai et al. | |
| 11,408,417 | B1 * | 8/2022 | Stephenson | E21B 43/2607 |
| 2013/0306322 | A1 * | 11/2013 | Sanborn | E21B 43/2607<br>166/308.1 |
| 2017/0012439 | A1 | 1/2017 | Zhang et al. | |
| 2017/0051598 | A1 | 2/2017 | Ouenes | |
| 2017/0130712 | A1 | 5/2017 | Zhang et al. | |
| 2020/0300073 | A1 | 9/2020 | Hinderliter et al. | |
| 2021/0131248 | A1 * | 5/2021 | Hinderliter | E21B 43/26 |
| 2022/0003229 | A1 * | 1/2022 | Mu | F04B 17/06 |
| 2022/0018234 | A1 * | 1/2022 | Reddy | F04B 23/04 |
| 2022/0074297 | A1 * | 3/2022 | Zheng | E21B 44/00 |
| 2022/0127944 | A1 * | 4/2022 | Chapman | F02C 6/00 |
| 2022/0136489 | A1 * | 5/2022 | Fisher | F04B 15/02<br>417/53 |
| 2022/0154555 | A1 * | 5/2022 | El Tawy | E21B 41/0085 |
| 2022/0162931 | A1 * | 5/2022 | Zhong | G01V 1/42 |
| 2022/0345007 | A1 * | 10/2022 | Liu | H02J 1/00 |

* cited by examiner

ASYMMETRIC POWER MANAGEMENT AND LOAD MANAGEMENT

TECHNICAL FIELD

The present disclosure relates generally to a hydraulic fracturing system that includes multiple hydraulic fracturing rigs and multiple power sources, and more particularly, to asymmetric power management of the hydraulic fracturing rigs and the multiple power sources.

BACKGROUND

Hydraulic fracturing is a means for extracting oil and gas from rock, typically to supplement a horizontal drilling operation. In particular, high pressure fluid is used to fracture the rock, stimulating the flow of oil and gas through the rock to increase the volumes of oil or gas that can be recovered. A hydraulic fracturing rig used to inject high pressure fluid, or fracturing fluid, includes, among other components, an engine, transmission, driveshaft, and pump.

Hydraulic fracturing may involve the use of a hydraulic fracturing system that includes multiple hydraulic fracturing rigs operating at a pressure based on the well head and running at the same or different flow rates to achieve an overall flow rate for the fluid (e.g., measured in barrels per minute). The hydraulic fracturing rigs may include a mix of mechanical and electrical hydraulic fracturing rigs. The hydraulic fracturing rigs may operate according to several different operational parameters and the power sources for the hydraulic fracturing rigs may differ by type of rig (and there may be multiple types of power sources for each type of rig). This can create a complex hydraulic fracturing system of various elements that may be difficult to control for certain objectives. This may result in wasted fuel or power resources, inefficient operation of hydraulic fracturing rigs, and/or the like.

U.S. Pat. No. 10,597,996 B2, granted on Mar. 24, 2020 ("the '996 patent") describes managing fuel and electrical power on a drilling rig. The number of gensets in use is changed before a change in power consumption is needed. However, the '996 reference does not asymmetrically manage power from various power sources (including multiple types of power sources) and asymmetrically manage load on various hydraulic fracturing rigs (including multiple types of hydraulic fracturing rigs).

The present disclosure may solve one or more of the problems set forth above and/or other problems in the art. The scope of the current disclosure, however, is defined by the attached claims, and not by the ability to solve any specific problem.

SUMMARY

In one aspect, a hydraulic fracturing system may include a plurality of electric power source outputs, a plurality of hydraulic fracturing rigs, and a non-transitory computer-readable medium storing instructions. The instructions, when executed by a processor of the hydraulic fracturing system, may cause the hydraulic fracturing system to perform asymmetric power management of the plurality of electric power source outputs and to perform asymmetric load management of the plurality of hydraulic fracturing rigs.

In another aspect, a method may include receiving information related to operation or a configuration of a hydraulic fracturing system. The hydraulic fracturing system may include a plurality of electric power source outputs and a plurality of hydraulic fracturing rigs. The method may further include performing, based on the information, asymmetric power management of the plurality of electric power source outputs. The method may further include performing, based on the information, asymmetric load management of the plurality of hydraulic fracturing rigs.

In yet another aspect, a controller for a hydraulic fracturing system may be configured to receive information related to operation or a configuration of the hydraulic fracturing system. The hydraulic fracturing system may include a plurality of electric power source outputs and a plurality of fracturing rigs. The controller may be further configured to perform, based on the information, asymmetric power management of the plurality of electric power source outputs. The controller may be further configured to perform, based on the information, asymmetric load management of the plurality of hydraulic fracturing rigs.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
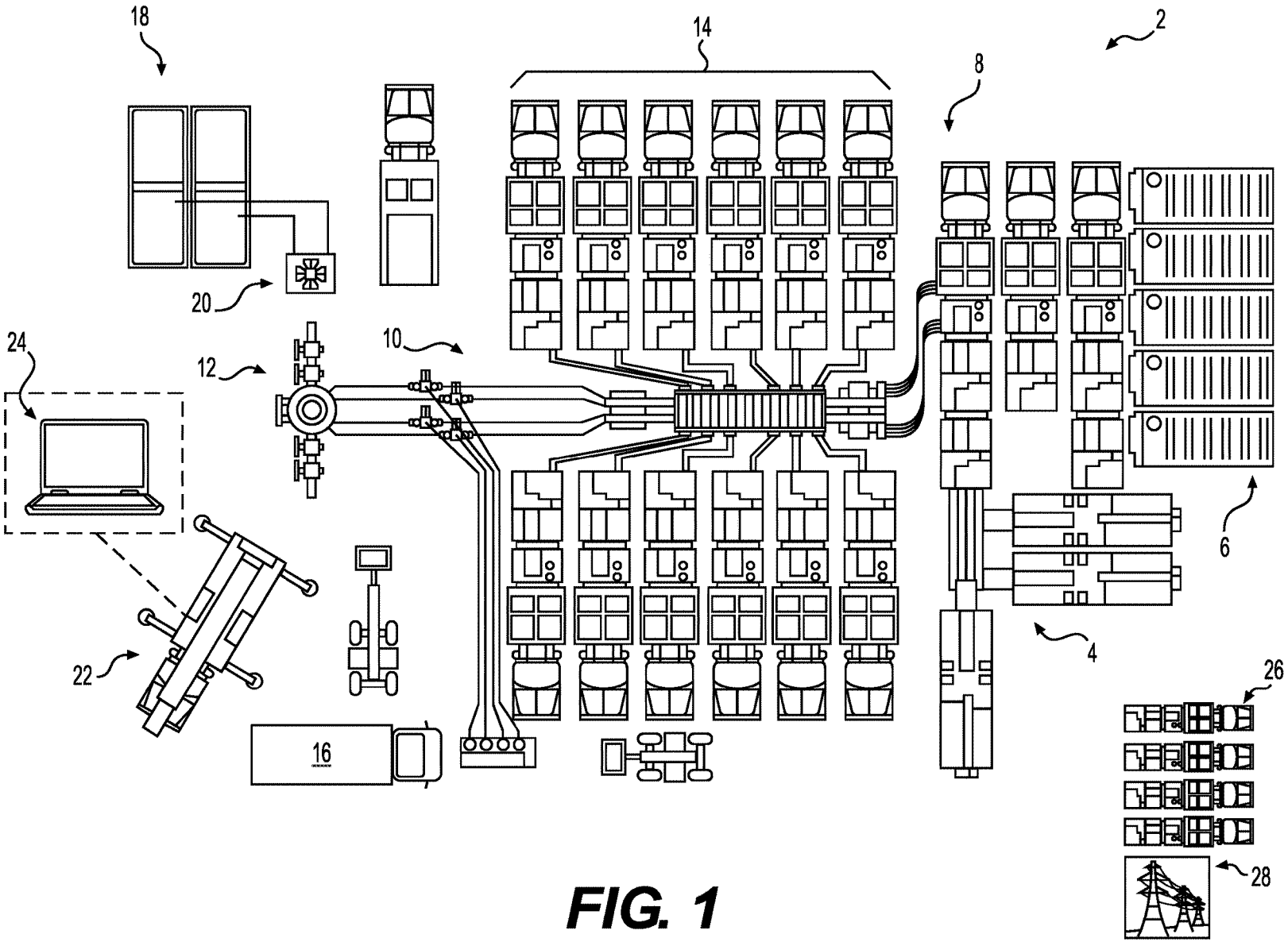
FIG. 1 is a schematic diagram of an exemplary hydraulic fracturing system including a plurality of hydraulic fracturing rigs and a plurality of power sources, according to aspects of the disclosure.

FIG. 1 illustrates an exemplary hydraulic fracturing system 2, according to aspects of the disclosure. In particular, FIG. 1 depicts an exemplary site layout according to a well stimulation stage (i.e., hydraulic fracturing stage) of a drilling/mining process, such as after a well has been drilled at the site and the equipment used for drilling removed. The hydraulic fracturing system 2 may include fluid storage tanks 4, sand storage tanks 6, and blending equipment 8 for preparing a fracturing fluid. The fracturing fluid, which may, for example, include water, sand, and one or more chemicals, may be injected at high pressure through one or more fluid lines 10 to a well head 12 using a plurality of hydraulic fracturing rigs 14. A hydraulic fracturing rig 14 may include a mechanical hydraulic fracturing rig 14 that includes, e.g., a gas or diesel engine, a pump, and a transmission. Alternatively, a hydraulic fracturing rig 14 may include an electric hydraulic fracturing rig 14 that includes, e.g., an electric motor, a variable frequency drive (VFD), and a pump.

A trailer-mounted bleed off tank 16 may be provided to receive bleed off liquid or gas from the fluid lines 10. In addition, nitrogen, which may be beneficial to the hydraulic fracturing process for a variety of reasons, may be stored in tanks 18, with a pumping system 20 used to supply the nitrogen from the tanks 18 to the fluid lines 10 or the well head 12.

The hydraulic fracturing process performed at the site, using the hydraulic fracturing system 2 of the present disclosure, and the equipment used in the process, may be managed and/or monitored from a single location, such as a data monitoring system 22, located at the site or at additional or alternative locations. According to an example, the data monitoring system 22 may be supported on a van, truck or may be otherwise mobile. As will be described below, the data monitoring system 22 may include a user device 24 for displaying or inputting data for monitoring performance and/or controlling operation of the hydraulic fracturing system 2. According to one embodiment, the data gathered by the data monitoring system 22 may be sent off-board or off-site for monitoring performance and/or performing calculations relative to the hydraulic fracturing system 2.

As further illustrated in FIG. 1, the hydraulic fracturing system 2 may include one or more power sources. For example, the one or more power sources may include one or more trailer-mounted generators 26 (e.g., gas, diesel, bi-fuel, or dual fuel generators 26), a utility power grid 28, energy storages (e.g., batteries or hydrogen fuel cells), and/or the like. Additionally, or alternatively, the one or more power sources may include gas turbines, renewable power sources, such as solar panels or wind turbines, and/or the like.

Figure 2:
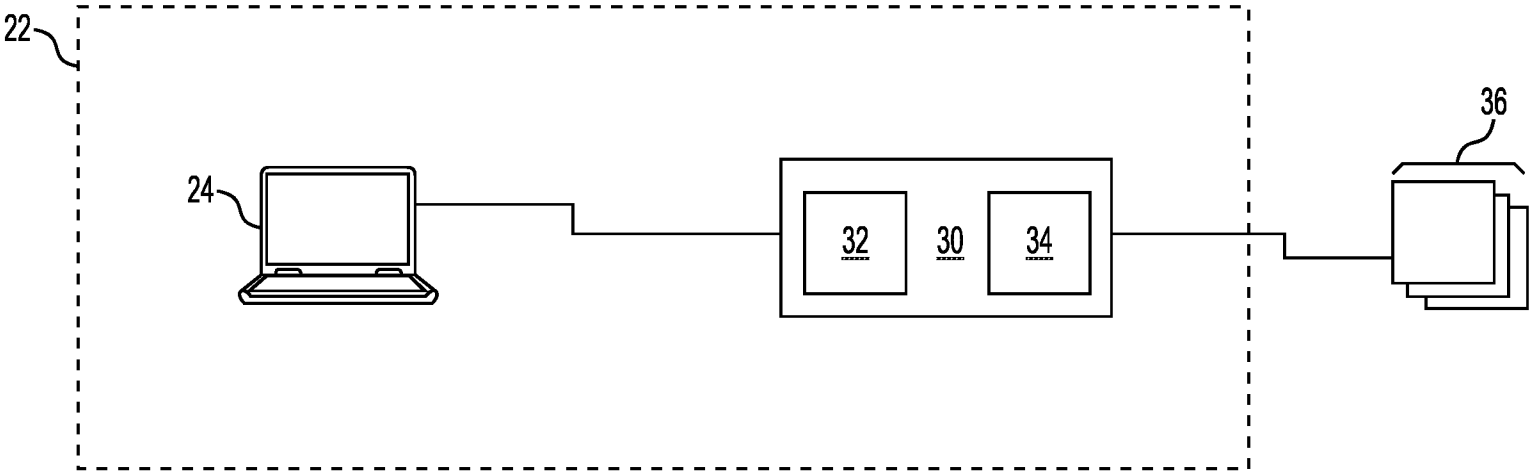
FIG. 2 is a schematic diagram of a data monitoring system and associated controllers of the hydraulic fracturing system of FIG. 1, according to aspects of the disclosure.

Referring to FIG. 2, the data monitoring system 22 may include the user device 24 and a controller 30 (e.g., a system controller 30). The controller 30 may be provided, and may be part of, or may communicate with, the data monitoring system 22. The controller 30 may reside in whole or in part at the data monitoring system 22, or elsewhere relative to the hydraulic fracturing system 2. The user device 24 and the controller 30 may be communicatively connected to each other via one or more wired or wireless connections for exchanging data, instructions, etc. Further, the controller 30 may be configured to communicate with one or more controllers 36 via wired or wireless communication channels. For example, the controller 30 may monitor and control, via the controllers 36, various elements of the hydraulic fracturing system 2. The controllers 36 may include a hydraulic fracturing rig controller for controlling a hydraulic fracturing rig 14, controllers for components of the hydraulic fracturing rigs 14 (e.g., controllers for an engine, transmission, motor, etc.) and/or a power source controller for controlling a power source.

The controllers 36 may be configured to communicate with one or more sensors (not shown in FIG. 2) associated with elements of the hydraulic fracturing system 2. A sensor may be configured to detect or measure one or more physical properties related to operation and/or performance of the various elements of the hydraulic fracturing system 2. For example, a sensor may be configured to provide a sensor signal indicative of operation of the hydraulic fracturing rigs 14 and/or the power sources to one or more of the controllers 36, which may be configured to provide the sensor signal to the controller 30.

The controller 30 and/or the controllers 36 may each include a processor and a memory (not illustrated in FIG. 2). The processor may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (AS SPs), system-on-a-chip systems (SOCs), complex programmable logic devices (CPLDs), etc. Additionally, the processor may possess its own local memory, which also may store program modules, program data, and/or one or more operating systems. The processor may include one or more cores.

The memory may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., the user device 24, a server device, etc.). The memory may be implemented as computer-readable storage media (CRSM), which may be any available physical media accessible by the processor to execute instructions stored on the memory. The memory may have an operating system (OS) and/or a variety of suitable applications stored thereon. The OS, when executed by the processor, may enable management of hardware and/or software resources of the controller 30 and/or the controllers 36.

The memory may be capable of storing various computer readable instructions for performing certain operations described herein (e.g., operations of the controller 30 and/or the controllers 36). The instructions, when executed by the processor and/or the hardware logic component, may cause certain operations described herein to be performed.

The controller 30 may store and/or execute an optimization program 32 to perform asymmetric load management and/or power management (e.g., based on data stored in the memory or as otherwise provided to the controller 30, such as via the user device 24, gathered by the controllers 36, or from a database). The controller 30 may store and/or execute a control logic program 34 (e.g., to control the hydraulic fracturing system 2 to operate within safe operating limits). Data used by the controller 30 may include operational priority and/or site configuration-related information, scheduling-related information, cost-related information, power source-related information, power demand-related information, and/or the like. However, various other additional or alternative data may be used.

Figure 3:
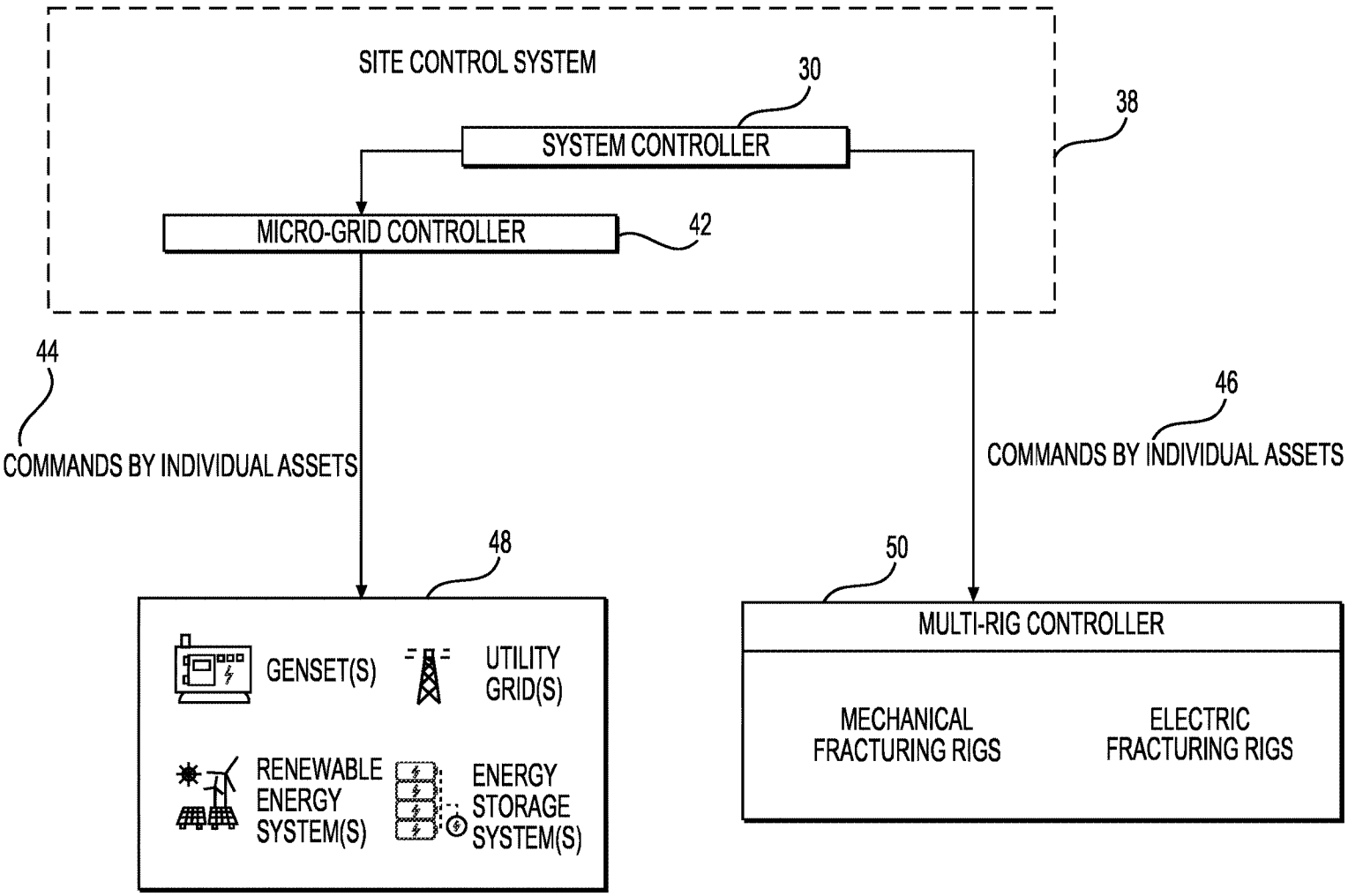
FIG. 3 is a diagram illustrating an exemplary system architecture for asymmetric power management and load management, according to aspects of the disclosure.

FIG. 3 is a diagram illustrating an exemplary system architecture for asymmetric power management and load management, according to aspects of the disclosure. For example, the system architecture may include a site control system 38 (e.g., part of, or separate from, the data monitoring system 22). The site control system 38 may include the system controller 30 and a micro-grid controller 42. For example, the micro-grid controller 42 may be one of the controllers 36 described herein and may be associated with controlling one or more of the power sources (e.g., a micro-grid 48 of various types of power sources). As illustrated in FIG. 3, the micro-grid controller 42 may be external to the micro-grid 48, which may facilitate parallel management of the power sources by a centralized device.

The micro-grid 48 may include one or more gensets (e.g., each genset may include on or more generators 26), one or more utility grids (e.g., one or more utility grids 28), one or more renewable energy systems, and/or one or more energy storage systems. As illustrated at 44, the micro-grid controller 42 may send, to the micro-grid 48, commands by individual assets. For example, the micro-grid 48 may send a separate set of instructions to each power source (e.g., to each genset, to each utility grid, to each renewable energy system, and to each energy storage system). The commands may control whether the power source is on, off, or idle, an amount of power output from the power source, and/or the like. Because the micro-grid controller 42 may provide separate commands to the power sources of the micro-grid 48, each power source may be controlled independently from the other power sources of the micro-grid 48.

As illustrated at 46, the system controller 30 may send, to a multi-rig controller 50, commands by individual assets. For example, the system controller 30 may send a separate set of instructions to each hydraulic fracturing rig 14 (e.g., to each mechanical fracturing rig 14 and/or to each electric hydraulic fracturing rig 14). The commands may control whether the hydraulic fracturing rig 14 is on, off, or idle, an amount of load on the hydraulic fracturing rig 14, and/or the like. Because the system controller 30 may provide separate commands to the hydraulic fracturing rigs 14, each hydraulic fracturing rig 14 may be controlled independently from the other hydraulic fracturing rigs 14 of the hydraulic fracturing system 2. The multi-rig controller 50 may be one of the controllers 36 described herein.

In some embodiments, just the electric hydraulic fracturing rigs 14 may need power from the micro-grid 48 since the mechanical hydraulic fracturing rigs 14 may have engines on the trailers. In this case, the system controller 30 may separate the load request from the electric hydraulic fracturing rigs 14 and mechanical hydraulic fracturing rigs 14 and may communicate the request of power needed for the electric hydraulic fracturing rigs 14 to the micro-grid 48 in connection with the commands sent at 44.

Figure 4:
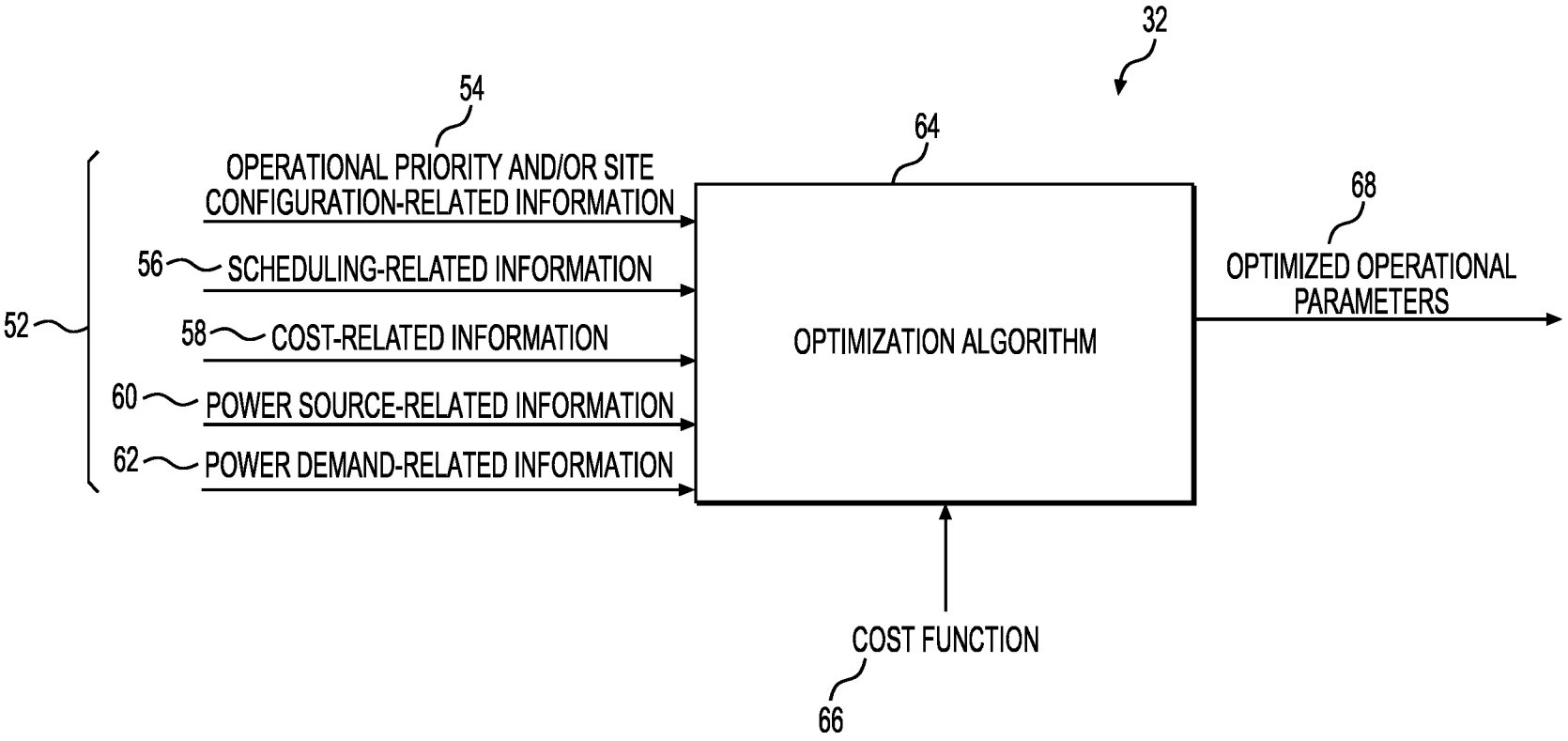
FIG. 4 is a diagram illustrating an exemplary optimization algorithm, according to aspects of the disclosure.

FIG. 4 is a diagram illustrating an exemplary optimization program 32, according to aspects of the disclosure. As illustrated in FIG. 4, the optimization program 32 may receive input data 52 and may provide the input data 52 to an optimization algorithm 64. For example, the optimization program 32 may receive the input data 52 from the user device 24 (e.g., a user may input the input data 52 via the user device 24), from a server device, from a database, from memory of various equipment or components thereof of the hydraulic fracturing system 2, and/or the like. The optimization program 32 may receive the input data 52 as a stream of data during operation of the hydraulic fracturing system 2, prior to starting operations of the hydraulic fracturing system 2, and/or the like. The input data 52 may be predetermined and provided to the optimization program 32 (e.g., may be based on experimental or factory measurements of equipment), may be generated by the controller 30 (e.g., the controller 30 may broadcast a ping communication at a site in order to receive response pings from equipment at the site to determine which equipment is present, the site controller 30 may measure, from sensor signals, the input data 52, etc.), and/or the like.

The input data 52 may include operational priority and/or site configuration-related information 54. For example, the operational priority and/or site configuration-related information 54 may include a priority among multiple hydraulic fracturing rigs 14, an operating mode priority for operation of the hydraulic fracturing rig 14 (e.g., a prioritization of fuel cost reduction over engine emissions reduction, or vice versa), a quantity of hydraulic fracturing rigs 14 at a site, a maximum allowed pressure or flow rate of a hydraulic fracturing rig 14 at the site, quantities and/or types of other equipment located at the site, ages, makes, models, and/or configurations of the equipment at the site, and/or the like. Additionally, or alternatively, the input data 52 may include scheduling-related information 56. For example, the scheduling-related information 56 may include times, dates, durations, locations, etc. for certain operations of the hydraulic fracturing system 2, such as scheduled times and dates for certain pump pressures, scheduled openings or closings of valves, etc.

Additionally, or alternatively, the input data 52 may include cost-related information 58. For example, the cost-related information 58 may include a cost of fuel or power for the hydraulic fracturing rig 14, a total cost of ownership of the hydraulic fracturing rig 14 (e.g., including maintenance costs, costs of fracturing fluid, or personnel costs), a cost of engine emissions (e.g., regulatory costs applied to engine emissions or costs related to reducing engine emissions, such as diesel exhaust fluid (DEF) costs), and/or the like. Additionally, or alternatively, the input data 52 may include power source-related information 60. For example, the power source-related information 60 may include numbers and/or types of power sources available at a site, configured power output ranges for the power sources, a cost of the power output from different types of power sources and/or individual instances of types of power sources, and/or the like. Additionally, or alternatively, the input data 52 may include power demand-related information 62. For example, the power demand-related information 62 may include a power demand for an experienced or expected load on an engine of a hydraulic fracturing rig 14 (e.g., flow, proppant demand, or pressure response), a desired flow rate of fracturing fluid, a desired output pressure of the fracturing fluid, a current gear ratio of a transmission of a hydraulic fracturing rig 14, a current transmission speed of the transmission, a desired pump input speed, and/or the like. The input data 52 may include various other types of data depending on the objective to be optimized by the optimization algorithm 64. For example, the input data 52 may include transmission gear life predictions, pump cavitation predictions, pump life predictions, engine life predictions, and/or the like.

As described in more detail below (e.g., with respect to FIGS. 5-7), the optimization algorithm 64 may process the input data 52 after receiving the input data 52. For example, the optimization algorithm 64 may process the input data 52 using a cost function 66. The optimization algorithm 64 may then output optimized operational parameters 68 for the hydraulic fracturing system 2 to the user device 24 for viewing or modification, to the controller 30 and/or the controllers 36 to control operations of the hydraulic fracturing system 2, and/or to a database for storage. Optimized operational parameters 68 may include, for example, power demand for individual hydraulic fracturing rigs 14, power output for individual power sources, a desired engine speed for a mechanical hydraulic fracturing rig 14, a desired transmission gear for a mechanical hydraulic fracturing rig 14, a desired kilowatt (kW) request from an electric hydraulic fracturing rig 14 to the micro-grid 48, and/or the like.

The optimization algorithm 64 may be configured to search for a set of optimized operational parameters 68 that achieve an objective. For example, in determining values for optimized operational parameters 68, the controller 30 may minimize or reduce an objective, maximize or increase an objective, and/or balance two or more objectives (e.g., maximize a first objective while keeping a second objective under a threshold value). In this way, "optimized," "optimization" and similar terms used herein may refer to selection of values (for operational parameters), based on some criteria (an objective), from a set of available values. An objective may be of any suitable type, such as minimizing the cost of fracturing operations of the hydraulic fracturing system 2, minimizing fuel or power consumption of the hydraulic fracturing system 2, minimizing engine emissions from the hydraulic fracturing system 2, maximizing an operational life of equipment of the hydraulic fracturing system 2, minimizing an overall time of the hydraulic fracturing operations, minimizing a cost of ownership of equipment used in the hydraulic fracturing operations, maximizing a maintenance interval of equipment of the hydraulic fracturing system 2, and/or any combinations thereof. As a specific example, the controller 30 may, given minimum operational expectations, maximize fuel or power savings, minimize engine emissions, minimize total cost of operation or ownership of the hydraulic fracturing system 2 considering the costs of various operational parameters, balance maintenance intervals and maintenance costs, and/or the like.

INDUSTRIAL APPLICABILITY

The aspects of the controller 30 of the present disclosure and, in particular, the methods executed by the controller 30 may be used to asymmetrically manage power source outputs and loads. For example, the methods executed by the controller 30 may individually control power outputs from different types of power sources and/or different instances of different types of power sources based on individualized operating characteristics of the power sources. Additionally, or alternatively, the methods executed by the controller 30 may individually control load on different types of hydraulic fracturing rigs 14 and/or different instances of different types of hydraulic fracturing rigs 14 based on individualized operating characteristics of the hydraulic fracturing rigs 14. Thus, certain aspects described herein may provide various advantages to the operation of the hydraulic fracturing rigs 14, such as individual optimization of power sources and hydraulic fracturing rigs 14 while achieving certain objectives, such as minimizing fuel or power consumption, optimizing maintenance intervals, etc. For example, the controller 30 may evaluate a desired mode of operation for the hydraulic fracturing system 2 (e.g., based on input to the controller 30) and may make real-time (or near real-time) decisions to operate individual power sources and hydraulic fracturing rigs on a cost-effective point based on, e.g., utility cost, fuel cost, health of equipment, and/or the like.

Figure 5:
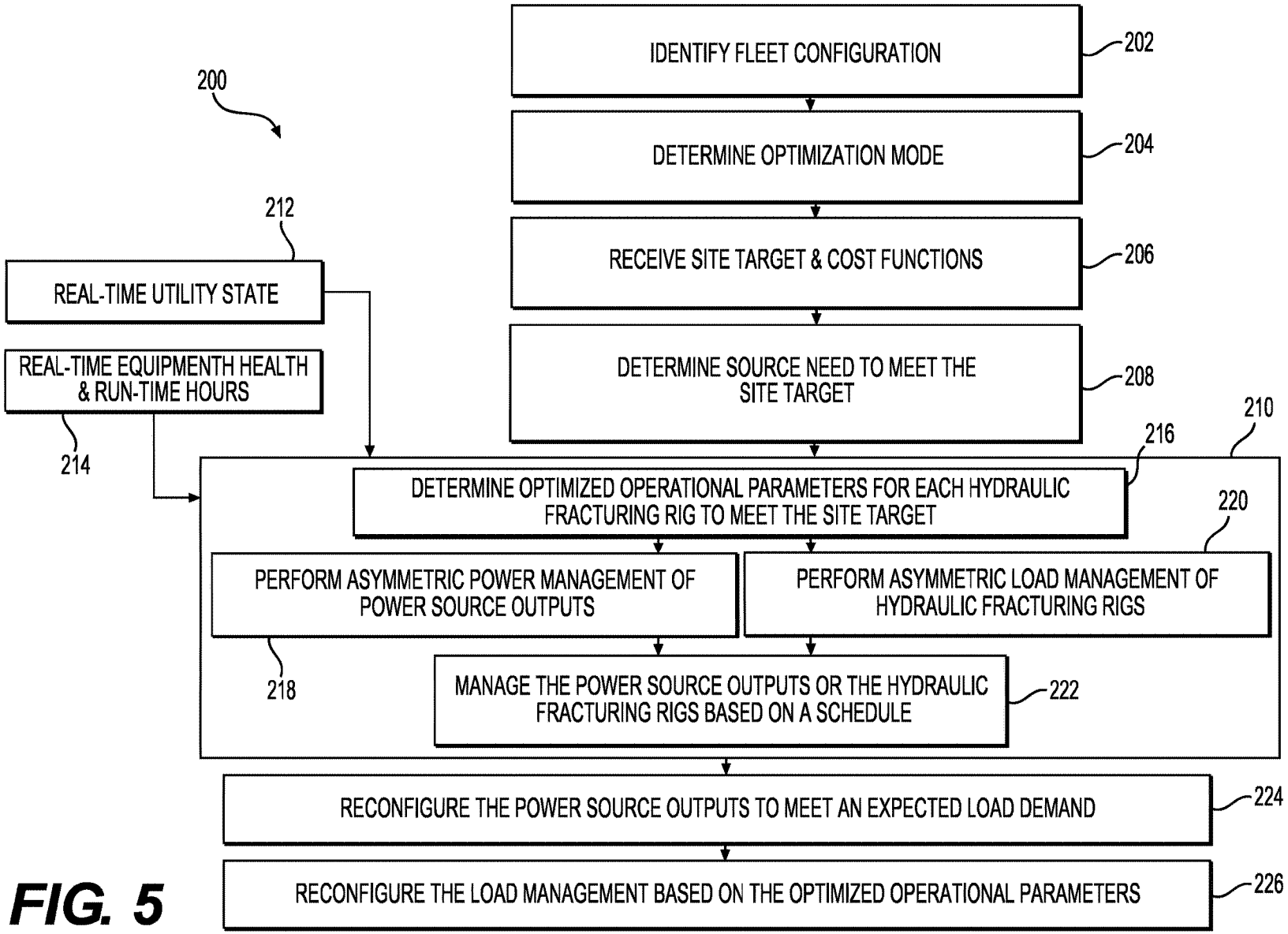
FIG. 5 is a flowchart depicting an exemplary method for asymmetric power management and load management, according to aspects of the disclosure.

FIG. 5 is a flowchart depicting an exemplary method 200 for asymmetric power management and load management, according to aspects of the disclosure. The method 200 illustrated in FIG. 5 may be implemented by the controller 30. The steps of the method 200 described herein may be embodied as machine readable and executable software instructions, software code, or executable computer programs stored in a memory and executed by a processor of the controller 30. The software instructions may be further embodied in one or more routines, subroutines, or modules and may utilize various auxiliary libraries and input/output functions to communicate with other equipment. The method 200 illustrated in FIG. 5 may also be associated with an operator interface (e.g., a human-machine interface, such as a graphical user interface (GUI)) through which an operator of the hydraulic fracturing system 2 may configure the optimization algorithm 64 and/or control logic program 34, may select the input data 52 or an operational mode for the hydraulic fracturing system 2, may set objectives for the optimization algorithm 64, and/or the like. Therefore, the method 200 may be implemented by the controller 30 to provide asymmetric load management or asymmetric power management.

At step 202, the method 200 may include identifying a fleet configuration. For example, the controller 30 may identify the types and/or number of hydraulic fracturing rigs 14 at a site (or included in the hydraulic fracturing system 2), a type and/or number of power sources at the site, a capacity of the power sources, and/or the like. At step 204, the method 200 may include determining an optimization mode. For example, the controller 30 may determine whether to optimize operations of the hydraulic fracturing system 2 according to a fuel mode (e.g., that minimizes fuel consumption or fuel costs during operation), a emissions mode (e.g., that minimizes engine emissions or costs of engine emissions during operation), a maintenance mode (e.g., that maximizes or optimizes a maintenance interval based on cost of operation or total cost of operation (TCO)), or a hybrid mode that combines one or more of the previously described modes.

At step 206, the method 200 may include receiving a site target and cost functions for the hydraulic fracturing system 2. For example, the controller 30 may receive information related to a requested pump flow and/or a target pressure for the site target. As another example, the controller 30 may receive a cost function for the operating mode (e.g., a first cost function for a fuel mode, a second cost function for an emission mode, a third cost function for a maintenance mode, or a fourth cost function for a hybrid mode). A cost function may include a mathematical function that maps values for one or more variables to a total score or cost. The optimization algorithm 64 may use the cost function to generate the optimized operational parameters 68, as described herein.

At step 208, the method 200 may include determining a source need to meet the site target. For example, the controller 30 may determine an engine speed and transmission gear for a mechanical hydraulic fracturing rig 14 to meet the site target, may determine an overall bus power for an electric hydraulic fracturing rig 14, and/or the like. After the step 208, the method 200 may include performing various steps 210. As input to the steps 210, the method 200 may include, at step 212, receiving information related to a real-time (or near real-time) utility state. For example, the controller 30 may receive the information at step 212. The real-time utility state may include a cost, health, provider signal, and/or the like related to the utility grid or one or more other power sources. Additionally, or alternatively, the method 200 may include, at step 214, receiving information related to real-time (or near real-time) equipment health and run-time hours. For example, the controller 30 may receive the information at step 214. The real-time equipment health may include an operating status of equipment of the hydraulic fracturing system 2 (e.g., an on/off/idle status), whether the equipment is operating within expected or acceptable operating limits, whether the equipment is operating in a manner likely to produce operating issues within a time period, and/or the like. The run-time hours may identify a quantity of hours that the equipment has been operated, an effective life of the equipment that has elapsed for a given quantity of hours of operation (e.g., operating the equipment in a less than ideal state may consume more of the equipment's life than for the same number of hours in an ideal state), and/or the like.

As part of the steps 210, the method 200 may include, at step 216, determining optimized operational parameters 68 for each hydraulic fracturing rig 14 to meet the site target. For example, the controller 30 may use the optimization algorithm 64 to determine the optimized operational parameters 68 based on an objective associated with an operating mode of the hydraulic fracturing system 2. At step 218, the method 200 may include performing asymmetric power management of power source outputs. For example, the controller 30 may allocate power output by power source type (e.g., micro-grid 48, energy storage, generator 26, etc.), by state of the power source (e.g., on/off/idle), and/or the like. At step 220, the method 200 may include performing asymmetric load management of the hydraulic fracturing rigs 14. For example, the controller 30 may determine, for a mechanical hydraulic fracturing rig 14, an operating state (e.g., on/off/idle), an engine speed for the engine of the hydraulic fracturing rig 14, a gear for the transmission of the hydraulic fracturing rig 14, and/or the like. Note that, in order to simplify the detailed description, the term "load management" is being used herein to refer to management of power usage of mechanical hydraulic fracturing rigs that have direct drive power on-board. As another example, the controller 30 may determine, for an electric hydraulic fracturing rig 14, an operating state, a motor speed of the motor of the hydraulic fracturing rig 14, and/or the like.

At step 222, the method 200 may include managing the power source outputs or the hydraulic fracturing rigs 14 based on a schedule. For example, for the power source outputs, the controller 30 may determine to increase or decrease power output from the power sources (e.g., by changing an operating state of a power source, by ramping operation of the power source up or down, managing utility import or export from the power sources, etc.) based on the job schedule for a site. Continuing with the previous example, the job schedule may indicate stages of hydraulic fracturing operations with increased or decreased activity, and the controller 30 may modify the power source outputs based on whether more or less power is needed during those stages. As another example, for the hydraulic fracturing rigs 14, the controller 30 may determine to increase or decrease load on the hydraulic fracturing rigs 14 (e.g., by changing an operating state of the hydraulic fracturing rigs 14, by ramping operation of the hydraulic fracturing rigs 14 up or down, etc.) based on the job schedule for a site. Continuing with the previous example, the controller 30 may modify the load on the hydraulic fracturing rigs 14 based on stages of increased or decreased hydraulic fracturing, as indicated by the job schedule.

At step 224, the method 200 may include reconfiguring the power source outputs to meet an expected load demand. For example, the controller 30 may determine a sequence of operations of the power sources that may facilitate a stable power source transition and may manage the power source outputs based on this determination. This may help to avoid power instability or power blackouts. At step 226, the method 200 may include reconfiguring the load management based on the optimized operational parameters. For example, the controller 30 may determine a sequence of operations of the hydraulic fracturing rigs 14 that may facilitate stable flow or pressure during hydraulic fracturing.

Figure 6:
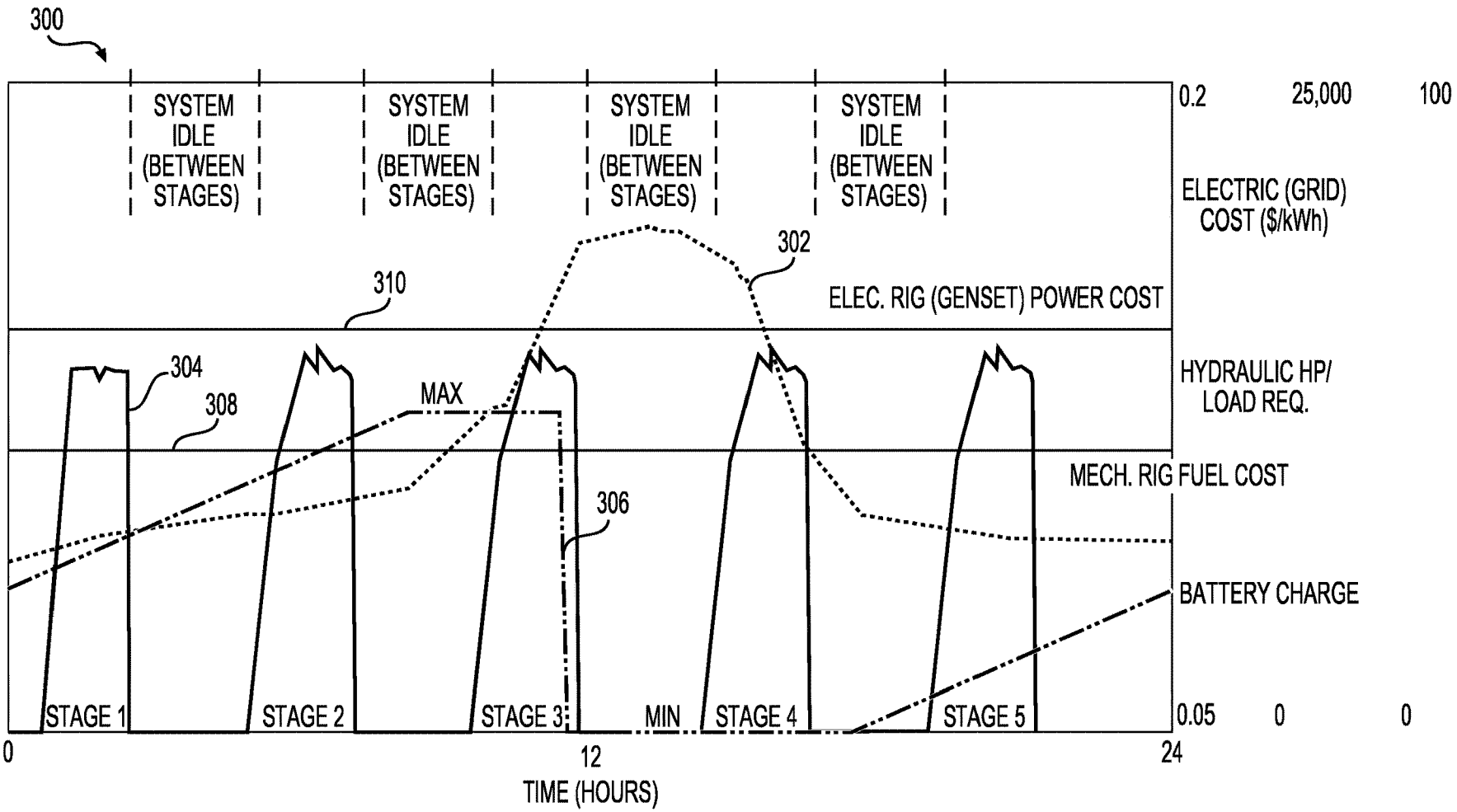
FIG. 6 illustrates an example hydraulic fracturing schedule, according to aspects of the disclosure.

FIG. 6 illustrates an example hydraulic fracturing schedule 300, according to aspects of the disclosure. The x-axis of the schedule illustrates time (hours) of a day from 0 to 24. The y-axis of the schedule illustrates three parameters: 1) electric grid cost (in dollars ($) per kilowatt hour (kWh)) from 0.05 to 0.2; 2) hydraulic horsepower (HP)/load requirement (in HP) from 0 to 25,000; and 3) battery charge in terms of percent from 0 to 100. The schedule 300 includes various hydraulic fracturing stages (stage 1, stage 2, stage 3, stage 4, and stage 5) where hydraulic horsepower or load is needed to pump hydraulic fracturing fluid through elements of the hydraulic fracturing system 2. In addition, the schedule 300 identifies portions of the time between stages where the hydraulic fracturing system 2 may be idle. The line 302 illustrates electric grid cost of the hydraulic fracturing operations over time. The line 304 illustrates the hydraulic horsepower/load requirement of the hydraulic fracturing system 2 over time. The line 306 illustrates battery charge of batteries of the hydraulic fracturing system 2 during operations of the hydraulic fracturing system 2. The line 308 illustrates an average mechanical rig 14 fuel cost and the line 310 illustrates an average electric rig 14 power cost.

Figure 7:
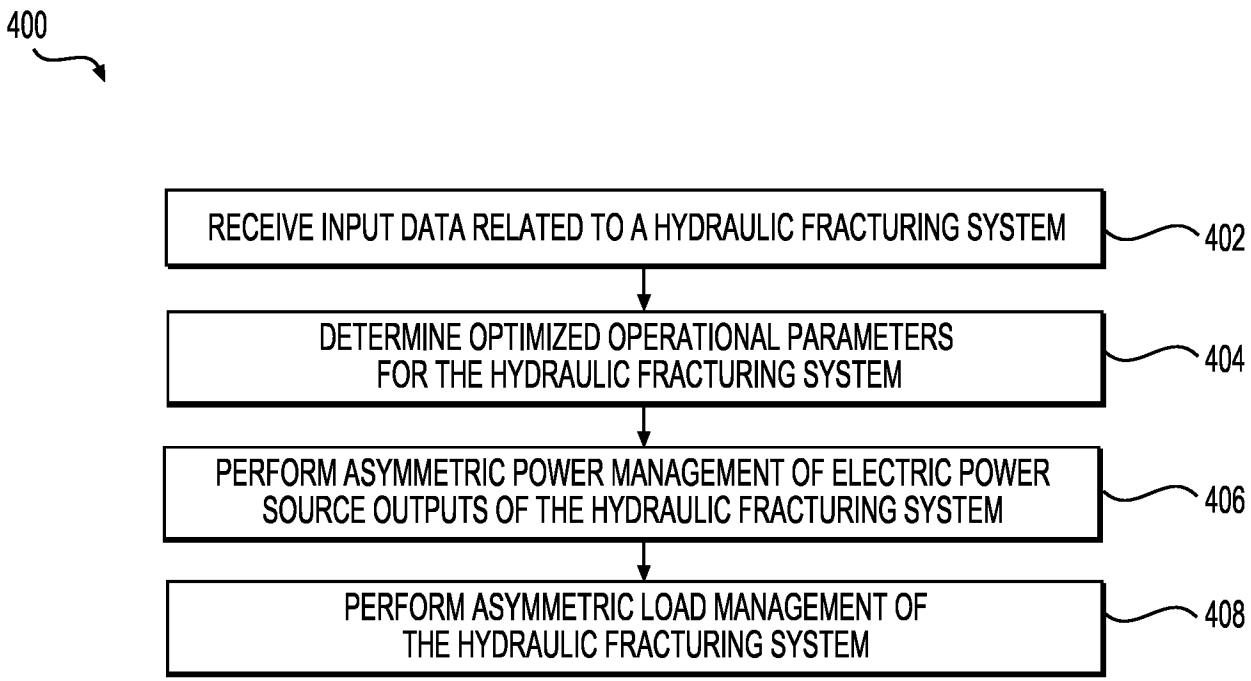
FIG. 7 illustrates a flowchart depicting an exemplary method for asymmetric power management and load management, according to an aspect of the disclosure.

FIG. 7 illustrates a flowchart depicting an exemplary method 400 for asymmetric power management and load management, according to aspects of the disclosure. The method 400 illustrated in FIG. 7 may be implemented by the controller 30. The steps of the method 400 described herein may be embodied as machine readable and executable software instructions, software code, or executable computer programs stored in a memory and executed by a processor of the controller 30. The software instructions may be further embodied in one or more routines, subroutines, or modules and may utilize various auxiliary libraries and input/output functions to communicate with other equipment. The method illustrated in FIG. 7 may also be associated with an operator interface (e.g., a human-machine interface, such as a graphical user interface (GUI)) through which an operator of the hydraulic fracturing rig 14 and/or the hydraulic fracturing system 2 may configure the optimization algorithm 64, may select the input data 52, may set objectives for the optimization algorithm 64, and/or the like. Therefore, the method 400 may be implemented by the controller 30 to provide asymmetric load management or asymmetric power management, for example.

At step 402, the method 400 may include receiving input data 52 related to a hydraulic fracturing system 2. For example, the controller 30 may receive the input data 52 from the user device 24 (e.g., as input from a user of the user device 24), from a sensor (e.g., associated with an element of the hydraulic fracturing system 2 and/or a component of an element), from a database (e.g., stored by the data monitoring system 22), from a server device (e.g., in a datacenter that is at a hydraulic fracturing site or remote to the hydraulic fracturing site), and/or the like. The controller 30 may receive the input data 52 prior to hydraulic fracturing operations beginning at a site, during the hydraulic fracturing operations, at scheduled intervals, when certain operating thresholds are exceeded or not met, and/or the like. In connection with the receiving at step 402, the controller 30 may further receive a cost function to be used by the optimization algorithm 64.

In connection with the receiving at 402, the controller 30 may further receive operating maps for equipment to be controlled. For example, the controller 30 may receive operating maps for one or more hydraulic fracturing rigs 14 from a database. The operating maps may include engine emissions maps, performance maps, fuel maps, and/or the like associated with the hydraulic fracturing rig 14. A map according to the present disclosure may provide an indication of output parameters of a particular equipment or component thereof as a function of input parameters, such as operating conditions of the hydraulic fracturing rig 14 or a component of the hydraulic fracturing rig 14. For example, an engine emissions map may indicate an amount of engine emissions as a function of engine speed and percentage of peak torque or as a function of power output and engine revolution rate. As another example, a performance map may indicate engine efficiency as a function of engine power output and engine age or may indicate parasitic loss of a pump as a function of flow rate and fluid output pressure. As yet another example, a fuel map (e.g., a brake specific fuel consumption (BSFC) map) may indicate a fuel efficiency of an engine based on the rate of fuel consumption and the power produced by the engine.

At step 404, the method 400 may include determining optimized operational parameters for the hydraulic fracturing system 2. For example, the controller 30 may select values for various operational parameters 68 for a hydraulic fracturing rig 14 and may determine fuel costs and engine emissions costs of the hydraulic fracturing rig 14 based on those values. In determining the values for the various operational parameters 68, the controller 30, via the optimization algorithm 64, may optimize one or more objectives. For example, the objective may be of any suitable type, such as reducing the cost of the fracturing operation, reducing engine emissions from the fracturing operation, reducing idle time during the fracturing operation, reducing wear on fracturing equipment during the fracturing operations, increasing efficiency of the fracturing operation, reducing an overall time of the fracturing operation, reducing the cost of ownership of the equipment used in the fracturing operation, and/or any combinations thereof. As a specific example, the controller 30 may determine optimized operational parameters 68 that minimize fuel costs or engine emissions costs according to certain maximum limits on such costs. As another specific example, if multiple operating points for the hydraulic fracturing rigs 14 provide lower operating costs, the controller 30, via the optimization algorithm 64, may select one of the points based on an objective, such as selecting the point with the lowest engine emissions output.

The determining of the operational parameters 68 may include a determination of an apportionment of power demand to various hydraulic fracturing rigs 14 included in the hydraulic fracturing system 2. To allow for hydraulic fracturing rigs 14 to be operated in a manner that optimizes the engine emissions produced by, and cost of fuel consumed by, multiple hydraulic fracturing rigs 14, the controller 30 may be configured to perform an optimization process that determines an optimized apportionment of the power demand to the individual operating hydraulic fracturing rigs 14 based upon minimizing engine emissions constrained by fuel cost limits. This may result in an equal or unequal apportionment of the power demand between different hydraulic fracturing rigs 14, and some hydraulic fracturing rigs 14 may be turned off. In some implementations, similarly configured hydraulic fracturing rigs 14 may be apportioned a similar or different proportion of the power demand.

Whether the controller 30 apportions the power demand based on total engine emissions and fuel costs may be determined by an operator of the hydraulic fracturing system 2 or it may be automatically determined based signals relating to other hydraulic fracturing system 2 functions. Accordingly, the controller 30 may be configured to receive information indicative of selection of a mode (e.g., an emission mode and/or a fuel mode), which may communicate to the controller 30 whether to enable the engine emission control mode and/or the fuel mode. The mode selection information may be input through the user device 24, for example in the data monitoring system 22, by an operator. Additionally, or alternatively, the mode selection information may also include information that may signal an automatic enablement of the apportionment of the power demand or power supply output such as, for example, information relating to the location of the hydraulic fracturing system 2 (e.g., in an area with certain limitations on engine emissions) and/or information relating to an operating mode of the hydraulic fracturing rigs 14. Additionally, or alternatively, the mode selection information may include information regarding whether the hydraulic fracturing system 2 is in a condition in which enablement of a mode may not be appropriate or a condition in which the mode may be enabled (e.g., enablement of a fuel mode or an emissions mode may not be appropriate unless hydraulic fracturing rigs 14 with a certain configuration are present at a site).

The determining at step 404 may be based on one or more cost functions for an operation mode. For example, the controller 30 may determine optimized operational parameters 68 based on whether values for the parameters cause the cost function to have a score that is equal to or greater than a threshold or that is equal to or less than the threshold.

At step 406, the method 400 may include performing asymmetric power management of electric power source outputs of the hydraulic fracturing system 2. For example, the controller 30 may determine a power source output for each power source individually, by type of power source, and/or the like. In some embodiments, the performing of the asymmetric power management may include causing power to be drawn or output from different electric power sources at different rates. For example, the controller 30 may control one power source to output power at, or to restrict power draw to, a lower level than another power source. In some embodiments, the determining at step 406 may include determining initial power source outputs for the power sources based on the operational parameters 68. For example, the controller 30 may determine power source outputs that satisfy a power demand for the hydraulic fracturing operations in accordance with the optimized operational parameters 68. Additionally, or alternatively, the determining at step 406 may include modifying the power source outputs after starting the hydraulic fracturing operations, e.g., to prevent blackouts or equipment stoppage (e.g., minimizing unplanned downtime), based on modified optimized operational parameters 68, based on an updated score from the cost function, and/or the like.

At step 408, the method 400 may include performing asymmetric load management of the hydraulic fracturing system 2. For example, the controller 30 may determine a load for each hydraulic fracturing rig 14 individually, by type of hydraulic fracturing rig 14, and/or the like. As a specific example, the asymmetric load management of step 408 may include operating a hydraulic fracturing rig 14 at a different operating point from another hydraulic fracturing rig 14. The different operating points may correspond to different output fracturing power levels (output fracturing power for the hydraulic fracturing system may equal discharge pressure times flow rate and power source output power may be kW input to an electric hydraulic fracturing system). The different operating points may be determined based on fuel parameters, engine emissions, or maintenance data. For example, a rig 14 with a higher fuel consumption rate may be operated at a lower output fracturing power level than another rig 14 with a lower fuel consumption rate. In some embodiments, one hydraulic fracturing rig 14 may have a different power output profile from another hydraulic fracturing rig 14 and the performing at step 408 may include distributing different loads to the hydraulic fracturing rigs 14 based on the different power output profiles. A power output profile may include an ideal operating pump torque and speed, an engineering specified pump torque and speed, a maximum operating pump torque and speed, a minimum operating pump torque and speed, and/or the like.

In some embodiments, one hydraulic fracturing rig 14 may have a different maintenance health profile from another hydraulic fracturing rig 14 and the performing at step 408 may include distributing different loads to the hydraulic fracturing rigs 14 based on the different maintenance health profiles. A maintenance health profile may include an expected life of a hydraulic fracturing rig 14 or a component thereof, a length of a time interval between maintenance periods for a hydraulic fracturing rig 14, an operating limit of a component (e.g., an engine, transmission, VFD, motor, or pump) of a hydraulic fracturing rig 14, an operating history of a hydraulic fracturing rig 14, an operating schedule of a hydraulic fracturing rig 14, and/or the like. Additionally, or alternatively, a maintenance health profile may include a score that indicates a current health of the hydraulic fracturing rig 14. For example, the maintenance health profile may indicate whether the hydraulic fracturing rig 14 (or a component thereof) has experienced a health-degrading event, such as exceeding a temperature limit, excessive torsion, abnormal behavior, excessive vibration, cavitation, fluid leakage, failure, etc.

In some embodiments, the performing at step 408 may be based on a prediction of flow capability of a hydraulic fracturing rig 14. For example, the controller 30 may use the optimization algorithm 64 to predict the flow capability based on a suction pressure, predicted cavitation, detected cavitation, valve leakage, areas of reduced torsional vibration, abnormal behavior, and/or the like for the hydraulic fracturing rig 14. In some embodiments, the performing at 408 may be based on characteristics of a discharge pressure and/or flow to the pump for the hydraulic fracturing rig 14. For example, the controller 30 may receive data from sensors regarding the discharge pressure and flow and may input the received data into the optimization algorithm 64 to determine an optimized load on the hydraulic fracturing rig 14. The controller 30 may then adjust blending equipment 8 to optimize the load on the hydraulic fracturing rig 14 (e.g., by sending control signals to the blending equipment 8).

In some embodiments, the performing at step 408 may include determining initial loads for the hydraulic fracturing rigs 14 based on the operational parameters. For example, the controller 30 may determine loads that satisfy a load demand for the hydraulic fracturing operations in accordance with the optimized operational parameters 68.

Additionally, or alternatively, the determining at step 408 may include modifying the load after starting the hydraulic fracturing operations, e.g., to help ensure effective or continued hydraulic fracturing operations (e.g., minimizing unplanned downtime), based on modified optimized operational parameters 68, based on an updated score from the cost function, and/or the like.

Although the method 400 illustrated in FIG. 7 is described as including steps 402 to 408, the method 400 may not include all of these steps or may include additional or different steps. For example, the method 400 may just include steps 406 and 408.

The controller 30 of the present disclosure can provide real-time (or near real-time) power and load management. Thus, aspects of the present disclosure may optimize power output and power consumption for reducing costs or engine emissions of hydraulic fracturing operations. This may improve operation of a hydraulic fracturing rig 14 without the hydraulic fracturing rig 14 experiencing a significant degradation in performance. In addition, aspects of the present disclosure may optimize load on various equipment of the hydraulic fracturing system 2. This may improve operations of the hydraulic fracturing system 2 by reducing engine emissions, reducing fuel consumption, etc. while satisfying a load demand for hydraulic fracturing operations. Other advantages of certain aspects of the present disclosure include providing optimization processes that are compatible with electric hydraulic fracturing rigs 14 and/or mixed fleets, seamless integration of providing power to load demand (e.g., reactive and predictive power output and load management), mixed fleet integration of gas, bi-fuel, dual fuel, and diesel power, optimization of power sources for fuel and carbon footprint reduction, and safe and efficient integration and management of power grids. Further, asymmetric management described herein may reduce or eliminate waste that may occur with evenly shared power assets.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic fracturing system, comprising:
a plurality of electric power source outputs;
a plurality of hydraulic fracturing rigs; and
a processor to:
perform asymmetric power management of the plurality of electric power source outputs; and
perform asymmetric load management of the plurality of hydraulic fracturing rigs,
wherein at least one of the asymmetric power management or the asymmetric load management is performed based on:
an indication of a prioritization of fuel cost reduction over engine emissions reduction, or
an indication of a prioritization of engine emissions reduction over fuel cost reduction.

2. The hydraulic fracturing system of claim 1, wherein, to perform the asymmetric load management, the processor is to:

operate the hydraulic fracturing rig at an operating point that is different from a different operating point at which at least one other hydraulic fracturing rig, of the plurality of hydraulic fracturing rigs, is operated.

3. The hydraulic fracturing system of claim 2, wherein the operating point and the different operating point correspond to different output power levels.

4. The hydraulic fracturing system of claim 2, wherein the operating point and the different operating point are based on a fuel consumption rate of the hydraulic fracturing rig.

5. The hydraulic fracturing system of claim 1, wherein , to perform the asymmetric power management, the processor is to:

cause power to be drawn from at least one electric power source output of the plurality of electric power source outputs at a different rate than from at least one other electric power source output of the plurality of electric power source outputs.

6. The hydraulic fracturing system of claim 1, wherein the plurality of hydraulic fracturing rigs comprises at least one electric hydraulic fracturing rig.

7. The hydraulic fracturing system of claim 1, wherein, to perform the asymmetric load management, the processor is to:

distribute different loads to the hydraulic fracturing rig and at least one other hydraulic fracturing rig, of the plurality of hydraulic fracturing rigs, further based on different power output profiles.

8. The hydraulic fracturing system of claim 1, wherein, to perform the asymmetric load management, the processor is to:

distribute different loads to the hydraulic fracturing rig and at least one other hydraulic fracturing rig, of the plurality of hydraulic fracturing rigs, further based on different maintenance health profiles.

9. A method, comprising:

receiving information related to operation or a configuration of a hydraulic fracturing system, wherein the hydraulic fracturing system comprises:

a plurality of electric power source outputs, and a plurality of hydraulic fracturing rigs, and wherein the information comprises one or more of:

an indication of a prioritization of fuel cost reduction over engine emissions reduction, an indication of a prioritization of engine emissions reduction over fuel cost reduction, a total cost of ownership of the hydraulic fracturing rig, or a cost of engine emissions related to the hydraulic fracturing system;

performing, based on the information, asymmetric power management of the plurality of electric power source outputs; and performing, based on the information, asymmetric load management of the plurality of hydraulic fracturing rigs.

10. The method of claim 9, wherein performing the asymmetric load management comprises:

operating the hydraulic fracturing rig at an operating point that is different from a different operating point at which at least one other hydraulic fracturing rig, of the plurality of hydraulic fracturing rigs, is operated.

11. The method of claim 10, wherein the operating point and the different operating point correspond to different output power levels.

12. The method of claim 10, wherein the operating point and the different operating point are based on at least one of:

fuel parameters, engine emissions, or maintenance data.

13. The method of claim 9, wherein performing the asymmetric power management comprises:

causing power to be drawn from at least one electric power source output of the plurality of electric power source outputs at a different rate than from at least one other electric power source output of the plurality of electric power source outputs.

14. The method of claim 9, wherein the plurality of hydraulic fracturing rigs comprises at least one electric hydraulic fracturing rig.

15. The method of claim 14, wherein:

at least one hydraulic fracturing rig of the plurality of hydraulic fracturing rigs comprises a power output profile that is different from a different power output profile of at least one other hydraulic fracturing rig of the plurality of hydraulic fracturing rigs, and wherein performing the asymmetric load management comprises:

distributing different loads to the at least one hydraulic fracturing rig and the at least one other hydraulic fracturing rig based on the power output profile and the different power output profile.

16. The method of claim 14, wherein:

at least one hydraulic fracturing rig of the plurality of hydraulic fracturing rigs comprises a maintenance health profile that is different from a different maintenance health profile of at least one other hydraulic fracturing rig of the plurality of hydraulic fracturing rigs, and wherein performing the asymmetric load management comprises:

distributing different loads to the at least one hydraulic fracturing rig and the at least one other hydraulic fracturing rig based on the maintenance health profile and the different maintenance health profile.

17. A non-transitory computer-readable medium storing instructions, the instructions comprising:

one or more instructions, that when executed by a controller of a hydraulic fracturing system, cause the hydraulic fracturing system to:

receive information related to operation or a configuration of the hydraulic fracturing system, wherein the hydraulic fracturing system comprises:

a plurality of electric power source outputs, and a plurality of hydraulic fracturing rigs;

wherein the information comprises at least one of:

an indication of a prioritization of fuel cost reduction over engine emissions reduction, or an indication of a prioritization of engine emissions reduction over fuel cost reduction;

perform, based on the information, asymmetric power management of the plurality of electric power source outputs; and perform, based on the information, asymmetric load management of the plurality of hydraulic fracturing rigs.

18. The non-transitory computer-readable medium of claim 17, wherein the hydraulic fracturing rig comprises an electric hydraulic fracturing rig.

19. The non-transitory computer-readable medium of claim 17, wherein the hydraulic fracturing rig of the plurality of hydraulic fracturing rigs comprises a power output profile that is different from a different power output profile of at least one other hydraulic fracturing rig of the plurality of hydraulic fracturing rigs.

20. The non-transitory computer-readable medium of claim 17, wherein the hydraulic fracturing rig comprises a maintenance health profile that is different from a different maintenance health profile of at least one other hydraulic fracturing rig of the plurality of hydraulic fracturing rigs.

* * * * *